United States Patent [19]

Fornasari

[11] Patent Number: 4,739,297

[45] Date of Patent: Apr. 19, 1988

[54] ELECTRIC RELAY WITH A THERMISTOR ASSOCIATED WITH A CASING ENCLOSING A THERMALLY EXPANDABLE MASS AND A ROD ACTUATING A ROCKER LEVER

[75] Inventor: Paolo Fornasari, Casale Monferrato, Italy

[73] Assignee: Eltek S.p.A., Casale Monterrato, Italy

[21] Appl. No.: 937,102

[22] Filed: Dec. 2, 1986

[30] Foreign Application Priority Data

Dec. 4, 1985 [IT] Italy ..... 68017 A/85

[51] Int. Cl.[4] ..... H01H 61/02; H01H 37/48

[52] U.S. Cl. ..... 337/120; 337/394

[58] Field of Search ..... 337/382, 383, 385, 386, 337/388, 389, 390, 391, 393, 394, 114, 118, 120, 123, 125, 126, 130

[56] References Cited

U.S. PATENT DOCUMENTS 3,166,893 1/1965 Sherwood ..... 337/120

*Primary Examiner*—Harold Broome

*Attorney, Agent, or Firm*—Browdy and Neimark

[57] ABSTRACT

An electric relay has a casing enclosing a thermally expandable mass associated with a thermistor (PTC) as a heat source, connected to an electric excitation circuit. A rod projects from said casing to come in contact with a rocker lever which, in conjunction with the reaction of a spring, causes a second spring to bend. The bending second spring moves an armature comprising a contact point, so that the contact point comes in contact with a second fixed contact point, thus closing an electric circuit. The elastic reaction of the springs and a tooth on the rocker lever bring the relay back to the resting position when power to the thermistor is interrupted.

6 Claims, 1 Drawing Sheet

ELECTRIC RELAY WITH A THERMISTOR ASSOCIATED WITH A CASING ENCLOSING A THERMALLY EXPANDABLE MASS AND A ROD ACTUATING A ROCKER LEVER

BACKGROUND OF THE INVENTION

Electric relays, particularly "all-or-none" types, generally comprise an electromagnet actuating an armature with a contact point against a fixed contact to open or close an electric circuit.

Proper operation of the above mentioned types of electric relays require an electromagnet and elastic devices of adequate size so that dependable, rapid opening is assured, and so that the contacts close without bouncing.

SUMMARY OF THE INVENTION

One of the purposes of the invention is to reduce the cost of commonly used relays where an electromagnet or solenoid constitutes the most costly component.

Other purposes of the invention are to guarantee rapid, dependable opening of the contacts when the relay goes from the operative to the resting position, and to eliminate contact bounce when the relay closes.

The present relay instead of including an electromagnet to actuate an armature uses an electrothermal device comprising a hermetically sealed casing, enclosing wax or other material with high thermal expandable properties, and an axially mobile rod projecting from said casing, which can come in contact with a rocker lever depending on how far said rod projects from the casing. Said rocker lever, shaped like a quadrant, when pressed by said rod against the reaction of elastic devices, moves horizontally against a cylindrical spring, which in turn causes an armature with a contact point to rapidly move against a fixed contact point closing an electric circuit. Said rocker lever is moved back to the resting position when the thermistor is no longer excited by said springs; a tooth on said rocker lever causes the armature to be retracted away from the fixed contact immediately interrupting the circuit.

BRIEF DESCRIPTION OF THE DRAWINGS

The invention will be described further, by way of example, with reference to the accompanying drawings in which.

DESCRIPTION OF PREFERRED EMBODIMENTS

Figure 1:
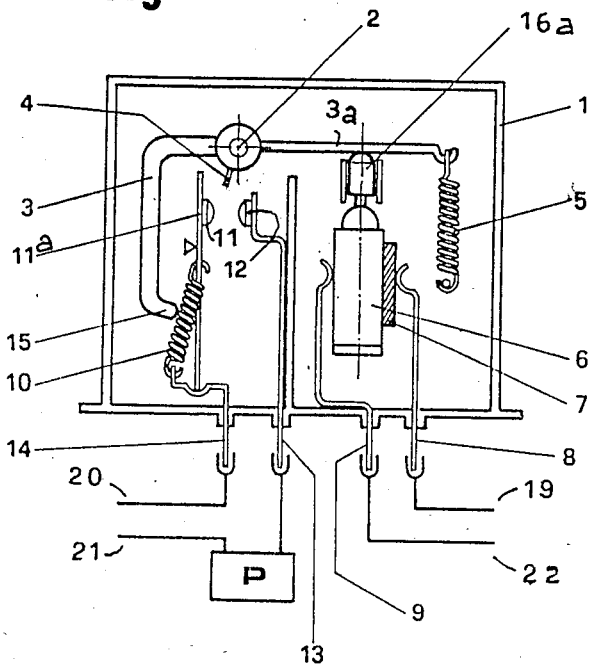
FIG. 1 is a drawing of the relay in the resting position.

With reference to FIG. 1, the relay housing 1 encloses the rocker lever 3,3*a* pivoting at 2. One end 3*a* is anchored with a spring 5, the opposite end 15 having a probe-like configuration is in contact with a cylindrical spring 10. Said spring 10 is anchored at one end on the armature 11*a*, and at the other end at the internal portion of the edge of the electrical terminal 14.

The armature 11*a* comprises a contact point 11 and can oscillate with respect to the internal portion of the terminal 14, and is electrically connected with said terminal. Terminal 13 is connected to a contact point 12 facing the mobile contact point 11. Rocker lever 3 comprises a tooth 4 which, when contact points 11 and 12 are closed (FIG. 2), touches the free end of the armature 11*a*. The head 16*a* of a rod 16 presses against the arm 3*a* of a rocker lever 3. Said rod passes through a seal 18 (FIG. 3), and is immersed in a mass 17 that has high thermal expandable properties, which is contained in a hermetically sealed casing 6. A thermistor (PTC) 7 is placed on the outer wall of the thermally conductive casing 6. Electric terminals 8 and 9 are connected to an electrical circuit 19,22 for exciting said thermistor 7. Contacts 11 and 12 are connected to power supply circuit 20,21 intended for any device P requiring power.

Figure 3:
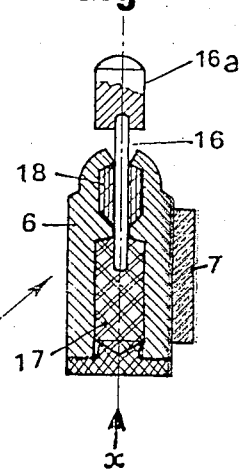
FIG. 3 is a vertical cut-away view of the thermoelectric device.

Relay operation is as follows:

If circuit 19,22 is supplied with electricity, the PTC 7 heats causing the expansion of the mass 17 and the axial movement of the rod 16 in the direction indicated by arrow —x— in FIG. 3. The head 16*a* of rod 16 forces the rocker lever 3 to move counterclockwise in an angular fashion.

Figure 2:
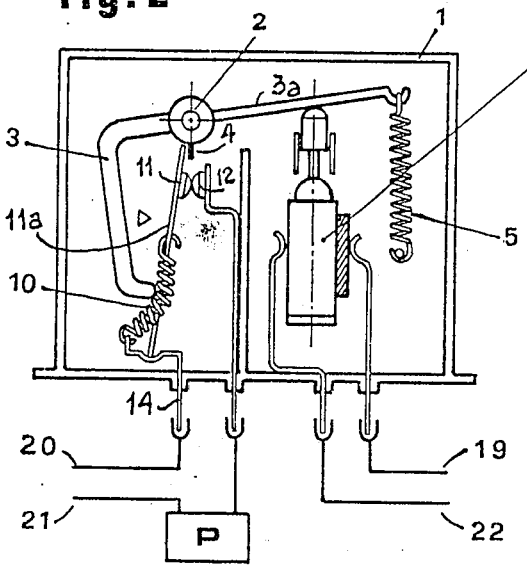
FIG. 2 shows the same relay when operative.

The angular motion of the rocker lever 3, one of whose ends 15 is in contact with a spring 10, causes said spring to bend as shown in FIG. 2, creating an imbalance of the armature 11*a* rapidly forcing it to move from the position shown in FIG. 1 to that illustrated in FIG. 2. This closes contact points 11 and 12 at a high pressure, which is the result of the extreme traction of the spring 10. Under these conditions, contact bounce between contact points 11 and 12 is prevented and the electric power supply circuit 20,21 for any electric device P is closed. .

When the thermistor 7 is no longer excited, the temperature of the mass 17 in the casing 6 drops, the reaction of the spring 5 forces the rod 16 back to the position shown in FIG. 1, and brings the rocker lever 3 back to the resting position. The tooth 4 is made of electrically insulated material, and is integral with the rocker lever 3. When said rocker lever 3 moves back to the resting position with an angular, clockwise motion, said tooth 3 touching the free end of the armature 11*a* rapidly separates contact points 11 and 12, thus preventing sticking of the contacts.

The present relay has a simple structure, is extremely dependable, and is durable considering that the thermally sensitive components 6,7,16 are not subject to failure as solenoids are.

The thermally sensitive component comprising a thermistor 7 can be structured so that the rod 16 moves longitudinally in a different or inverse way with respect to that described. Furthermore, the relay can have multiple contacts instead of the pair 11 and 12.

I claim:

1. A device comprising a casing containing material with high-thermal-dilatative properties and a rod extending out a hole in said casing in accordance with temperature of said material, a thermistor thermally connected with said casing to heat said material, a rocker lever having a first end which is effectively operatively contacted by said rod and moved when said temperature of said material in said casing is sufficiently raised by said thermistor, a pair of contact points, a first one of said contact points being movable from an open position as a result of operative contact with a second end of said rocker lever to close said contact points, and said rocker lever comprising opening means operatively associated with one of said pair of contact points for ensuring rapid opening of said contact points when the temperature of said material is sufficiently reduced by ceasing the heating with said thermistor.

2. The device of claim 1, said opening means comprising a tooth provided on said rocking lever and made of electrically insulating material, for returning said movable contact to a resting open position, thus assuring said rapid opening of said pair of contact points and preventing sticking between said movable contact and the other of said pair of contacts.

3. The device of claim 1, comprising two elastic devices operatively connected with said rocker arm, a first one of said elastic devices biasing against rotation of said rocker arm caused by said extension by said rod out of said hole in said casing, as said thermistor heats said material, and the second of said elastic devices acting to open said pair of contacts by moving said movable contact thereof as said material cools after said heating thereof by said thermistor is stopped.

4. The device of claim 1, comprising an armature on a top end of which said movable contact is rigidly mounted, said second elastic device being a spring connected at a first end thereof to a part of said armature below said top end thereof, and at a second end, wherein said rocker lever, when moved from a resting position by said rod extending out of said casing when said material is sufficiently heated by said thermistor, causes said spring to bend and said armature to move to close said pair of contact points, and when said rod sufficiently retreats into said casing after said heating by said thermistor ceases, said spring acts to reopen said pair of contact points by returning said armature to said resting position.

5. The device of claim 1, wherein a gap between said pair of contact points, when said armature is in said resting position is at least 3 mm, whereby said device is particularly suited for use in appliance power circuits.

6. The device of claim 1, said armature being rotatably secured at a bottom end thereof, in part by a second end of said spring being connected at a distance therefrom on the same side of said armature from which said second end of said rocker lever contacts said spring, for closing said pair of contacts.

* * * * *